US006341434B1

(12) United States Patent
Yeh

(10) Patent No.: US 6,341,434 B1
(45) Date of Patent: Jan. 29, 2002

(54) INNER SOLE OF A SHOE CONTAINING WEIGHTS

(76) Inventor: Pai-Yi Yeh, Fl. 1, No. 102, Rei An Street, Taipei City (TW)

( * ) Notice: Subject to any disclaimer, the term of this patent is extended or adjusted under 35 U.S.C. 154(b) by 0 days.

(21) Appl. No.: 09/610,530

(22) Filed: Jul. 7, 2000

(51) Int. Cl.[7] ..... A43B 5/00
(52) U.S. Cl. ..... 36/132; 36/103
(58) Field of Search ..... 36/132, 136, 103; 482/79

(56) References Cited

U.S. PATENT DOCUMENTS 3,517,928 A * 6/1970 Shanahan
4,252,315 A * 2/1981 Kimura
4,709,921 A * 12/1987 Valuikas et al.
5,638,613 A * 6/1997 Williams
5,758,435 A * 6/1998 Miyata

FOREIGN PATENT DOCUMENTS

GB 2100969 A * 1/1983

* cited by examiner

*Primary Examiner*—Ted Kavanaugh
(74) *Attorney, Agent, or Firm*—Rosenberg, Klein & Lee

(57) ABSTRACT

An inner sole containing weights includes a plurality of cables having first and second ends, a first metal member connected with the first ends of the cables, a second metal member connected with the second ends of the cables and having a distance from the first metal member, and a rubber enclosure completely enclosing the cables, the first and second metal members, whereby the conventional inner sole containing weights has the advantage of not being easily worn out or broken.

4 Claims, 4 Drawing Sheets

PRIOR ART

INNER SOLE OF A SHOE CONTAINING WEIGHTS

BACKGROUND OF THE INVENTION

1. Field of the Invention

This invention is related to an inner sole containing weights, and in particular to one containing a number of heavy metal plates, and wires which connect the heavy plates, all of which are completely enclosed by rubber. This invention is for the purpose of exercising the legs. In comparison with the conventional inner sole containing weights, this invention has the advantage of not being easily worn out or broken.

2. Description of the Prior Art

Strong legs are helpful to the health and quality of life of human beings. For the person who seldom walks, but rather sits and/or lies for the majority of his or her time, health problems such as poor blood circulation in the upper part of the body are likely to occur.

There is a well-known principle that, like strong trees with strong roots, only a person with strong legs can have a strong body. However, many people nowadays use various means of transportation rather than walking, and they are becoming unaccustomed to using their feet to cover large distances. The era of walking as a significant means of travel has passed. Hence, in order to retain a healthy physique while still keeping up with the increased speed of daily life, many people are undertaking planned exercise similar to that of an athlete's.

In order to strengthen the foot or leg muscle, methods such as placing sand or metal blocks on or against the knee are commonly used so as to increase the load on the leg(s) while walking or running. However, these methods will cause damage to the movement of the joint, or even cause harm to the joint itself. In addition, wearing iron shoes to practice using and strengthening legs has also been proposed. The drawback of iron shoes is even more serious than the use of sandbags or metal blocks. Recently, an inner sole containing lead blocks which are connected by metal wires has been proposed to fit into a sports shoe, on which is placed a commonly used insole, as shown in FIGS. 1A and 1B. The insole contains three lead plates: 100, 101 and 102 which are made by filling melted lead into a mold. The metal wires 200 and 201 are put into the mold before lead is filled into the mold so that two gaps 120 and 121 are formed between the first and second lead plates 100, and the second and third leadplates 101 and 102, respectively. The metal wires 200 and 201 are formed with teeth 200A and 201A respectively so as to strengthen the engagement between the lead plates 100, 101 and 102. Then, silicone rubber 300 is poured into the mold to fill in the two gaps 120 and 121 so as to prevent the metal wires 200 and 201 from injuring the wearer.

However this kind of metal insole suffers from the following drawbacks:

1. The metal wires are easily broken or become detached from the iron blocks after having been bent a number of times. According to experiments, those metal wires will break in about 20 days after running, jumping or kicking.
2. The gap between each lead plate is filled with silicon rubber, but because the connection between different materials cannot last a long time, the rubber will perish or break after a certain period of time.
3. Because lead is poisonous, it must be sprayed with non-toxic paint. But as the lead will rub with the inner side of the outer sole, the paint will gradually disintegrate into powder and will scatter on the user's toe area. Thus, the poisoned surface of the lead will be exposed, causing potential harm to the user.

Therefore, it is an object of the present invention to provide an improvement in the structure of an inner sole containing weights which can obviate and mitigate the above-mentioned drawbacks.

SUMMARY OF THE INVENTION

This invention is related to an inner sole containing weights, and in particular to one containing a number of heavy metal plates, and wires which connect the heavy plates, all of which are completely enclosed by rubber. This invention is for the purpose of exercising the legs. In comparison with the conventional inner sole containing weights, this invention has the advantage of not being easily worn out or broken.

According to a preferred embodiment of the present invention, an inner sole containing weights includes a plurality of cables having first and second ends, a first metal member connected with the first ends of the cables, a second metal member connected with the second ends of the cables and having a distance from the first metal member, and a rubber enclosure completely enclosing the cables, the first and second metal members.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figures 1A, 1B:
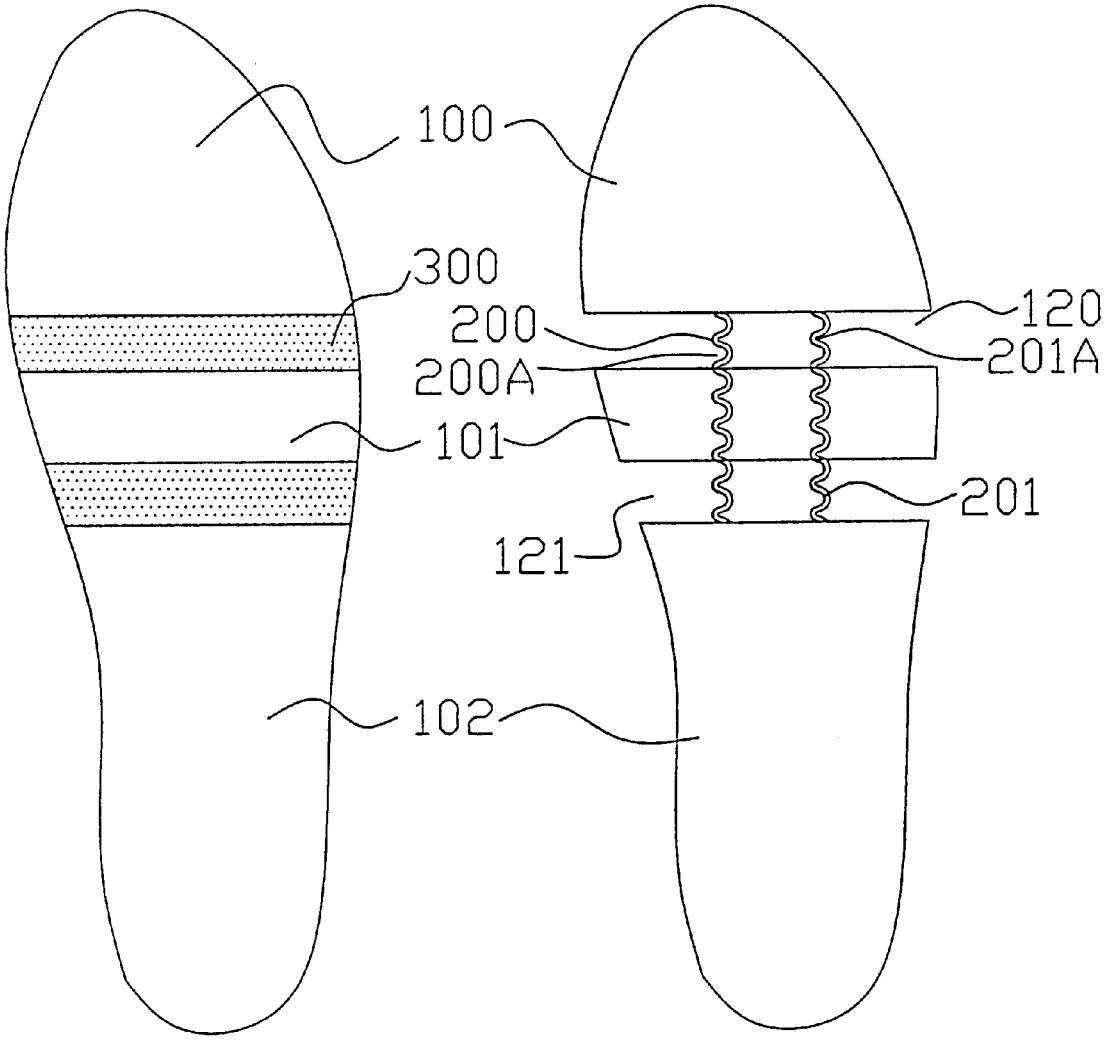
FIG. 1A PRIOR ART
FIG. 1A is a plan view of a prior art shoe sole with weights therein.
FIG. 1B illustrates the structure of the prior art shoe sole with weights therein.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
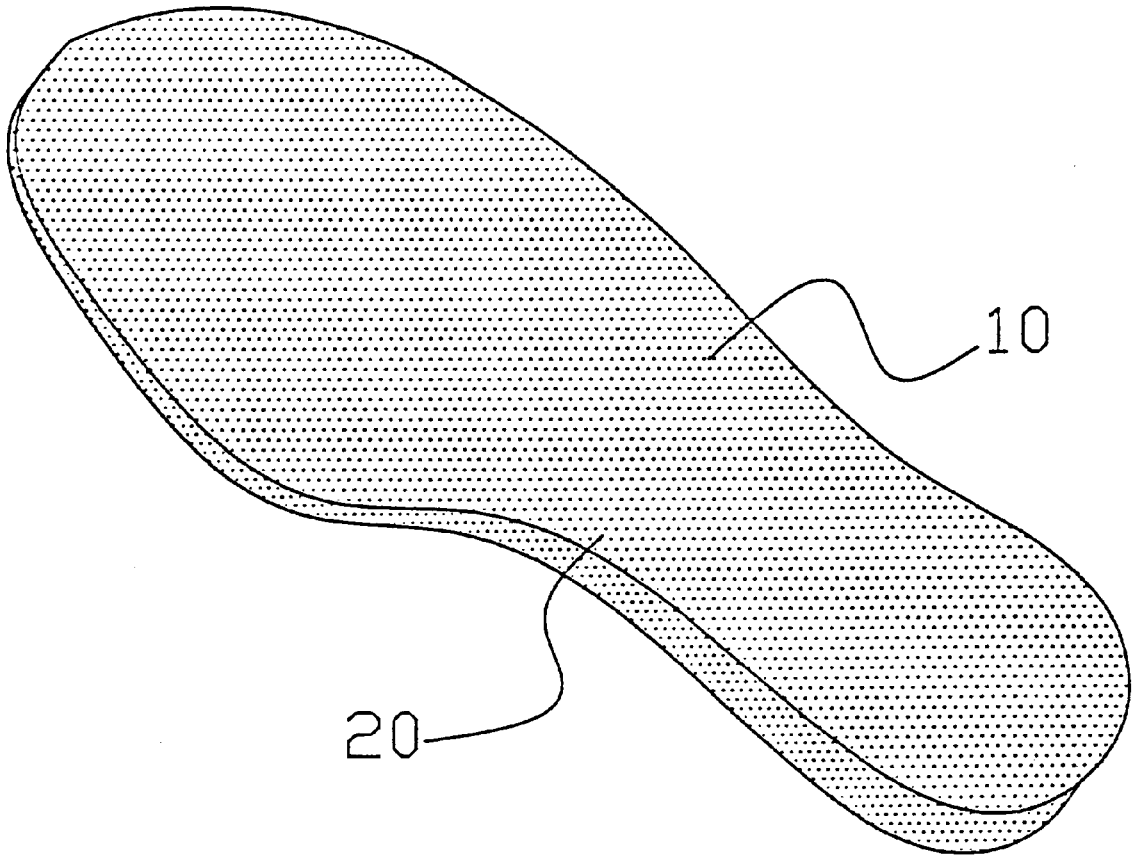
FIG. 2 is a perspective view of a shoe sole with weights therein according to the present invention.
Figure 3:
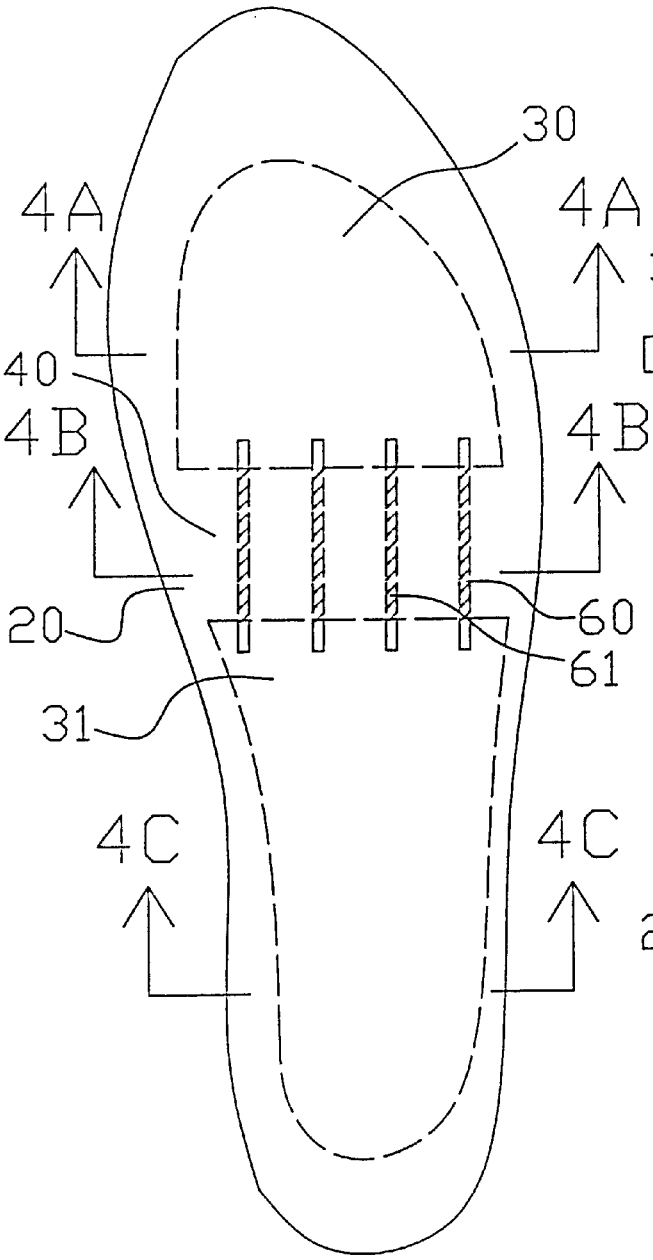
FIG. 3 is top view illustrating the structure of the present invention.
Figure 4A:
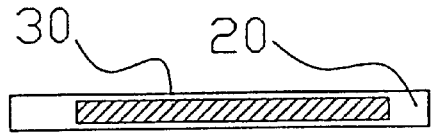
FIG. 4A is a sectional view taken along line 4A—4A of FIG. 3.
Figure 4B:
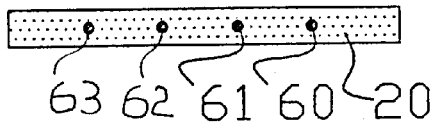
FIG. 4B is a sectional view taken along line 4B—4B of FIG. 3.
Figure 4C:
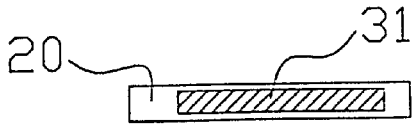
FIG. 4C is a sectional view taken along line 4C—4C of FIG. 3.

With reference to the drawings and in particular to FIG. 2 thereof, the shoe sole 10 according to the present invention is completely enclosed with a rubber enclosure 20. As shown in FIGS. 3, 4A, 4B and 4C, the shoe sole 10 according to the present invention comprises two metal members 30 and 31 joined together by four cables 60, 61, 62 and 63 with a diameter of 1.5 mm. the metal members 30 and 31 may be made of high density metal such as lead or the like. The method of manufacturing the shoe sole 10 comprises the steps of first placing the cables 60, 61, 62 and 63 within a mold (not shown), pouring melted metal into the mold so as to form the first metal member 30 configured for supporting the planar arch and the heel of a user and connected with an end of the cables 60,61, 62 and 63, and the second metal member 31 for supporting the transverse arch of the user and connected with the other end of the cables 60, 61, 62 and 63 thereby forming a distance 40 between the first and second metal members 30 and 31 and causing the cables 60, 61, 62 and 63 to support the ball of the foot of the user, and then enclosing the first and second metal members 30 and 31, and the cables 60 with rubber enclosure 20. As the cables 60, 61, 62 and 63 are located at the position for supporting the ball of a foot, the foot of a user will have no problem in bending his or her foot in running or walking. Furthermore, as the first and second metal members 30 and 31 and the cables 60, 61, 62 and 63 are completely enclosed within the rubber enclosure 20, it is only necessary to put the first and second metal members 30 and 31 and the cables 60, 61, 62 and 63 in a mold and then to fill the rubber into the mold by injection.

Figure 5:
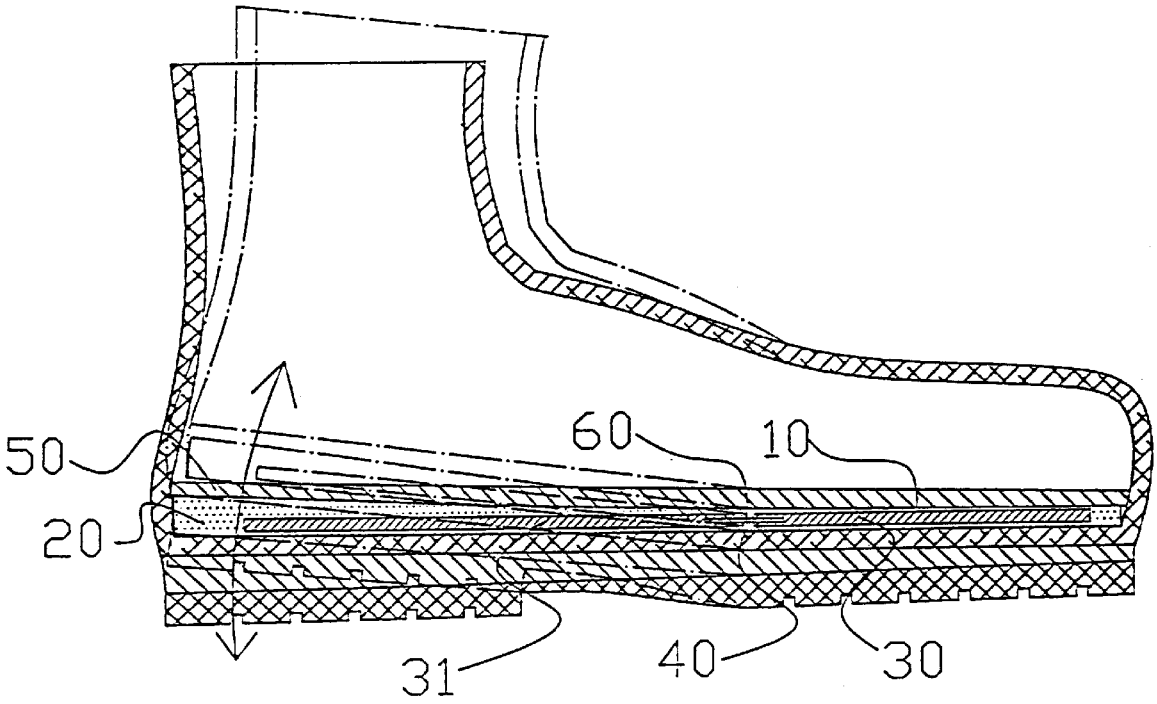
FIG. 5 is a working view of the present invention.

Referring to FIG. 5, the inner sole lining 50 is removed from a shoe, the shoe sole 10 according to the present invention is put inside the shoe, with the first metal member 30 arranged on the front portion of the shoe and the second metal member 31 on the rear portion of the shoe, and then the inner sole lining 50 is placed on the shoe sole 10. The shoe sole 10 maybe affixed in the shoe in adhesive for keeping the shoe sole 10 at a fixed position. Further, the user has to buy a larger shoe for providing additional room for receiving the shoe sole 10. In addition, as the cables 60, 61, 62 and 63 are enclosed by the rubber enclosure 20, the cables 60, 61, 62 and 63 will not be broken even after a long period of use.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An inner sole, comprising:

a first metal member;

a second metal member displaced from said first metal member a predetermined distance;

a plurality of cables linearly extending between said first and second metal members and supporting a ball portion of a user's foot; and a rubber enclosure completely enclosing said cables, and said first and second metal members.

2. The inner sole as claimed in claim 1, wherein said metal members are made of lead.

3. The inner sole as claimed in claim 1, wherein each of said plurality of cables has a diameter approximating 1.5 mm.

4. The inner sole as claimed in claim 3, wherein said plurality of cables is defined by four cables extending between said first and second members.

* * * * *